US006226963B1

(12) United States Patent
Rychlak et al.

(10) Patent No.: US 6,226,963 B1
(45) Date of Patent: May 8, 2001

(54) BAG CLAMPING APPARATUS

(75) Inventors: Gerald J. Rychlak, Garfield; Robert Hemphill, Wayne, both of NJ (US)

(73) Assignee: Chronos Richardson, Inc., Fairfield, NJ (US)

( * ) Notice: Subject to any disclaimer, the term of this patent is extended or adjusted under 35 U.S.C. 154(b) by 0 days.

(21) Appl. No.: 08/872,556

(22) Filed: Jun. 10, 1997

(51) Int. Cl.[7] ..... B65B 39/10
(52) U.S. Cl. ..... 53/473; 53/284.7; 141/316
(58) Field of Search ..... 53/473, 269, 570, 53/284.7; 141/114, 316, 315, 314, 313

(56) References Cited

U.S. PATENT DOCUMENTS 4,432,186 * 2/1984 McGregor ..... 53/284.7 X
4,706,441 * 11/1987 Chervalier ..... 53/284.7 X
5,115,619 * 5/1992 Lieder ..... 53/284.7 X
5,301,492 4/1994 Kader ..... 53/459

* cited by examiner

*Primary Examiner*—James F. Coan
(74) *Attorney, Agent, or Firm*—Howard L. Rose

(57) ABSTRACT

Valving employed to control side closing elements of bag clamping apparatus of a bag filling machine is altered to cause the elements to move slowly to close the sides of a bag being filled whereby air is permitted to escape externally through slowly closing openings at the sides of the bag. At a predetermined time determined by the size and contents of the bag the openings are closed rapidly thereby sealing the bag once fitted.

7 Claims, 6 Drawing Sheets

*Fig. 4*

| STEP NO. | STEP DESCRIPTION | DEVICE NAME | | | | TERMINATE STEP BY |
|---|---|---|---|---|---|---|
| | | GUSSET FORM & FACE CLAMP CLOSED | GUSSET FORM & FACE CLAMP OPEN | BIRD BEAK CLAMP OPEN | BIRD BEAK CLAMP CLOSED | |
| | | A | B | C | D | |
| 1 | HOME POSITION | | X | | X | |
| 2 | PLACE BAG | | X | | X | |
| 3 | GRIP & CLAMP BAG | X | | | X | |
| 4 | OPEN BIRD BEAK | X | | X | | |
| 5 | DISCHARGE (FILL BAG) | X | | X | | |
| 6 | BAG HANG TIME | X | | X | | |
| 7 | RE-FORM BAG | X | | | X | |
| 8 | RELEASE & TRANSFER | | X | | X | |

*Fig.6*

| STEP NO. | STEP DESCRIPTION | DEVICE NAME | | | | | | | | | TERMINATE STEP BY |
|---|---|---|---|---|---|---|---|---|---|---|---|
| | | FACE CLAMP CLOSED | GUSSET GRIP & FACE CLAMP OPEN | BIRD BEAK CLAMP OPEN | BIRD BEAK CLAMP CLOSED | GUSSET FORM IN | GUSSET FORM OUT | LOW PRESSURE (ONE BAR) | HIGH PRESSURE (SIX BAR) | VENT HIGH PRESSURE TO ATMOSPHERE | |
| | | A | B | C | D | E | F | G | H | J | |
| 1 | HOME POSITION | | X | | X | | X | | X | | |
| 2 | PLACE BAG | | X | | X | | X | | X | | |
| 3 | GRIP & CLAMP BAG | X | | | X | | X | | X | | |
| 4 | GRIP AT LOW PRESSURE | X | | | X | | X | X | | X/O | |
| 5 | OPEN BIRD BEAK | X | | X | | | X | X | | | |
| 6 | DISCHARGE (FILL BAG) | X | | X | | | X | X | | | |
| 7 | HIGH PRESSURE CLAMP | X | | X | | X | | | X | | |
| 8 | BAG HANG TIME | X | | X | | X | | | X | | |
| 9 | REFORM BAG | X | | | X | | X | | X | | |
| 10 | RELEASE & TRANSFER | | X | | X | | X | | X | | |

BAG CLAMPING APPARATUS

CROSS-REFERENCE TO RELATED APPLICATIONS

Not Applicable

STATEMENT REGARDING FEDERALLY SPONSORE RESEARCH OR DEVELOPMENT

Not Applicable

The present invention relates to bag clamping apparatus and more particularly to a modification of the sequencing of the operation of the side sealing air cylinders of U.S. Pat. No. 5,301,492 to allow de-aeration of a bag externally rather internally.

BACKGROUND OF THE INVENTION

In the aforesaid U.S. patent, air in a bag being filled escapes internally of the filling nozzle and reduces the area for product flow.

It is a primary object of the present invention to utilize in its entirety the apparatus illustrated in the aforesaid patent but to modify the sequencing of an element of the apparatus to permit air to escape externally through small open edge regions of the bag that are not closed until the bag is partially full.

BRIEF SUMMARY OF THE INVENTION

The structure of the apparatus employed in the present invention is identical to that illustrated in U.S. Pat. No. 5,301,492 and the description of operation is also identical except as specifically modified herein. Thus the description of operation of the device of the patent is incorporated herein by reference.

The only change relative to the device of the patent is in the sequencing of the gusset forming air cylinder 21 of FIG. 2 of the patent. In the patent the side sealing air cylinder caused the actuating elements 25 to grip and seal the edge of the bag against the end faces 3 of the filling spout and thus seal the bag. In consequence evacuation of air was internal.

According to the present invention this air cylinder is independently controlled such that the air cylinder is initially driven to extend by a low pressure, 1 bar, to maintain elements 25 away from the end faces 3 whereby openings in the edge regions of the bag are provided through which air may escape during filling externally to atmosphere. After a predetermined time which varies with bag size, the valve is switched to allow high pressure (6 bars) to be applied to cylinder 21 to rapidly bring the arms 25 against the end faces 3 and seal the bag. This action occurs when the bag is partially full. The degree of filling is a function of the material filling the bag. As determined by grain size, weight of the material, the bag is sealed at a time before dust and fines begin to escape.

The change in operation is achieved by the addition of three valves, two three-way, one four-way valve and a pressure regulator to control air flow to air cylinder 21.

The above and other features, objects and advantages of the present invention, together with the best means contemplated by the inventors thereof for carrying out the invention will become more apparent from reading the following description of a preferred embodiment and perusing the associated drawings in which:

BRIEF DESCRIPTION OF THE DRAWINGS

FIG. 4 is a valve operating chart for the valves of FIG. 3;

FIG. 6 is an operating chart of the sequencing of the cylinders of the invention.

DETAILED DESCRIPTION OF THE INVENTION

Figure 1:
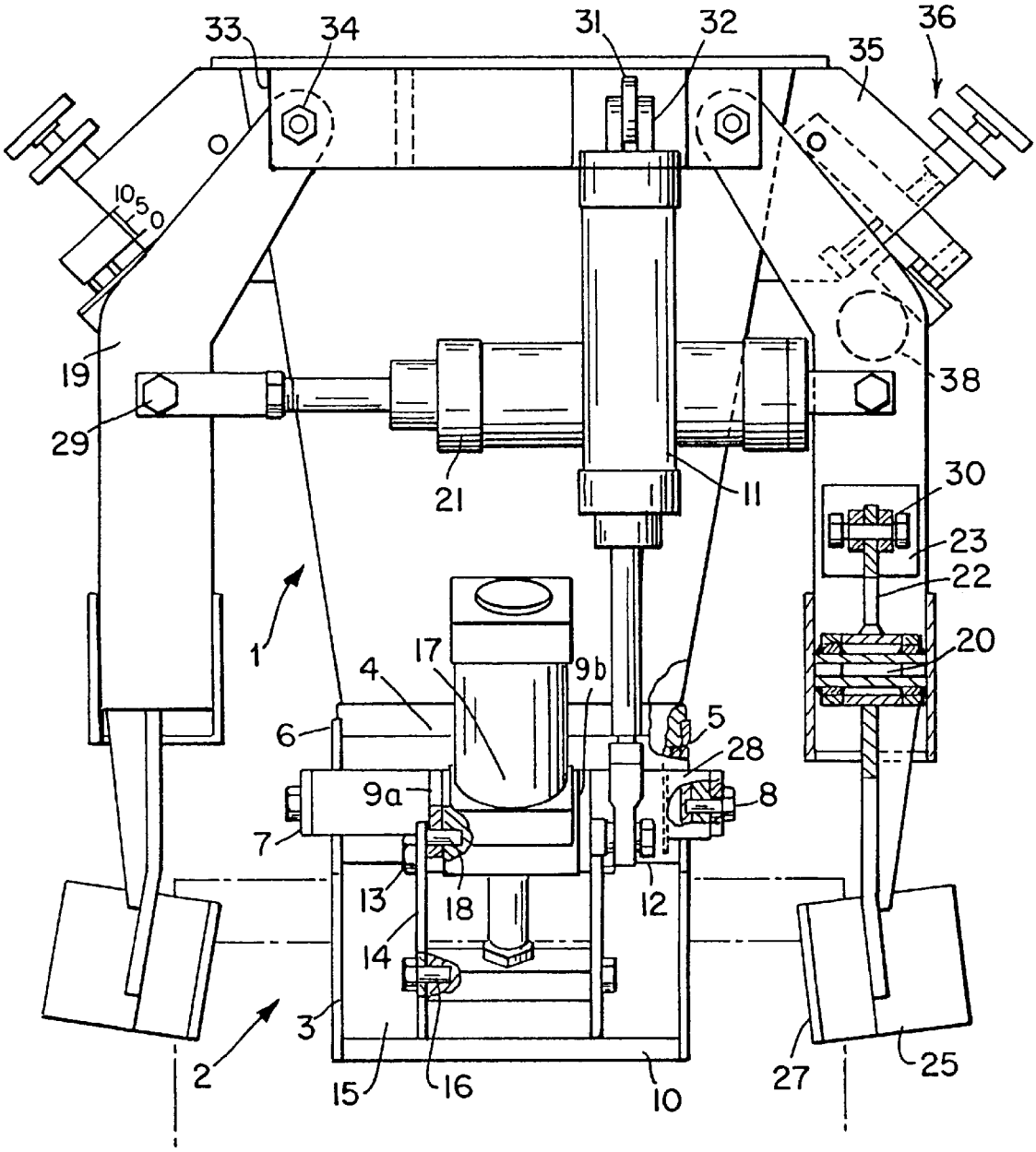
FIGS. 1 and 2 are the FIGS. 1 and 2 of U.S. Pat. No. 5,301,492.
Figure 2:
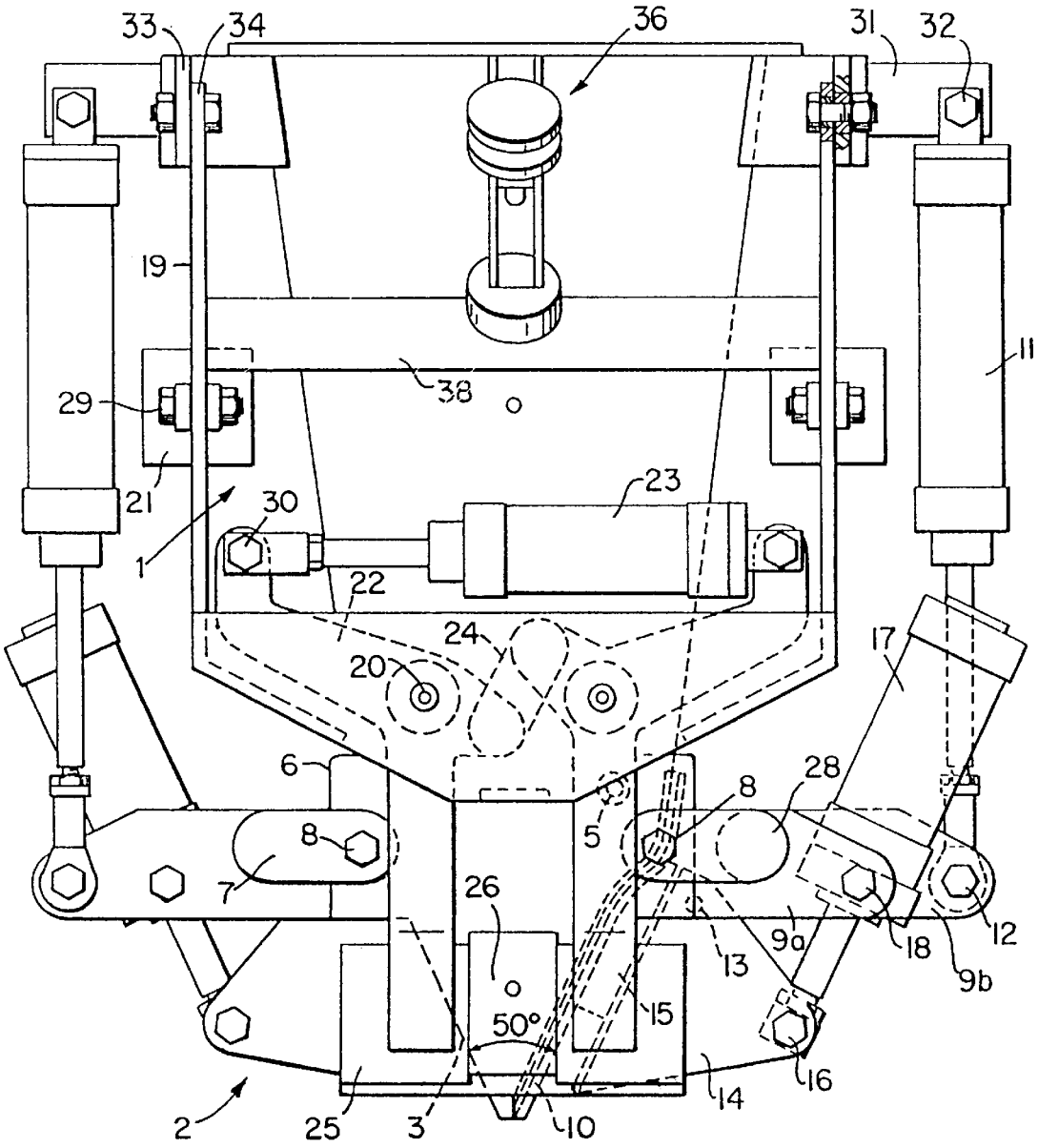

Referring to FIGS. 1 and 2, the operation of all elements is as stated in the patent except the operation of the air cylinder 21. This cylinder controls the movement of the actuating elements 25 to move the coplanar pressure faces 27 to press the loosely open ends of a bag against end faces 3 of the filling spout.

Figure 3:
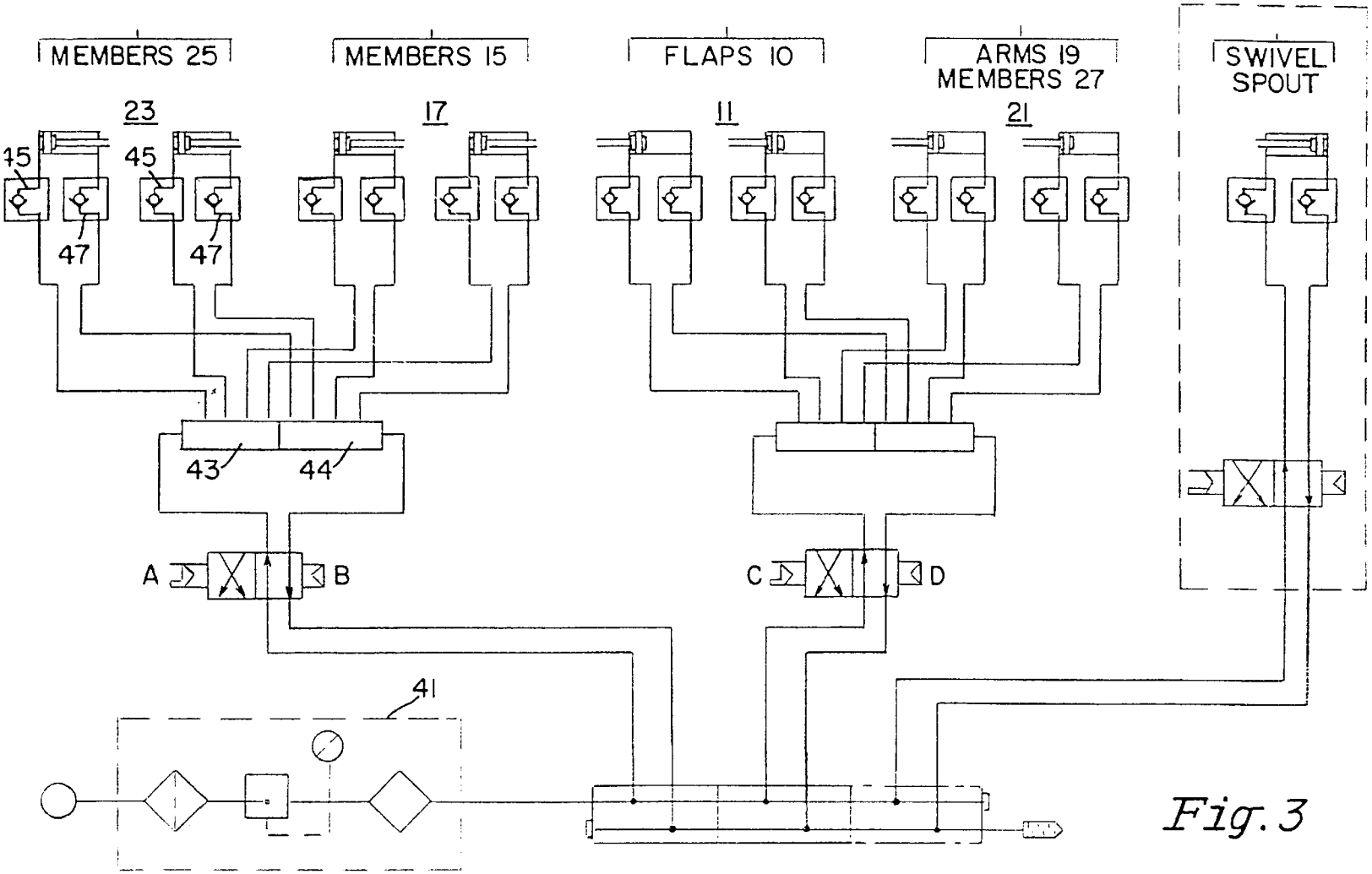
FIG. 3 is a schematic diagram of the original valve controls for the various air cylinders employed in controlling the apparatus of FIGS. 1 and 2.

Referring to FIG. 3, the valve controls, valves A, B, C & D for the four air cylinders 23, 17, 11 and 21 are illustrated. The operation sequence of these valves is illustrated in FIG. 4. An "X" indicates that the solenoid controlling the valve is energized.

Air cylinder 23 is, as are all of the air cylinders, illustrated in its start position, that is, prior to a bag being placed on the apparatus. The cylinders 23, 17, 11 and 21 are fed pressurized air from a source 41 via valves A and B/C and D. One or the other of the valves supplies air to manifold 43 or 44 and 55 or 56, respectively. The pressure lines supply air to the cylinders through one-way adjustable exhaust controls 45 and 47 located on each port of each air cylinder.

In operation, upon a bag being placed on the spout, elements 11 and 23 are activated, valve A, FIG. 4. The bird beak 10, is then opened and gusset 27 is brought against side 3 by valve C to air cylinders 11 and 21. The bag is filled and the valves return to the condition illustrated in columns A–D (valves A–D) of FIG. 4.

It should be noted that the elements as set forth in FIGS. 1 and 2 are not necessarily in their start position, for instance, elements 22 are in the bag clamping position.

Figure 5:
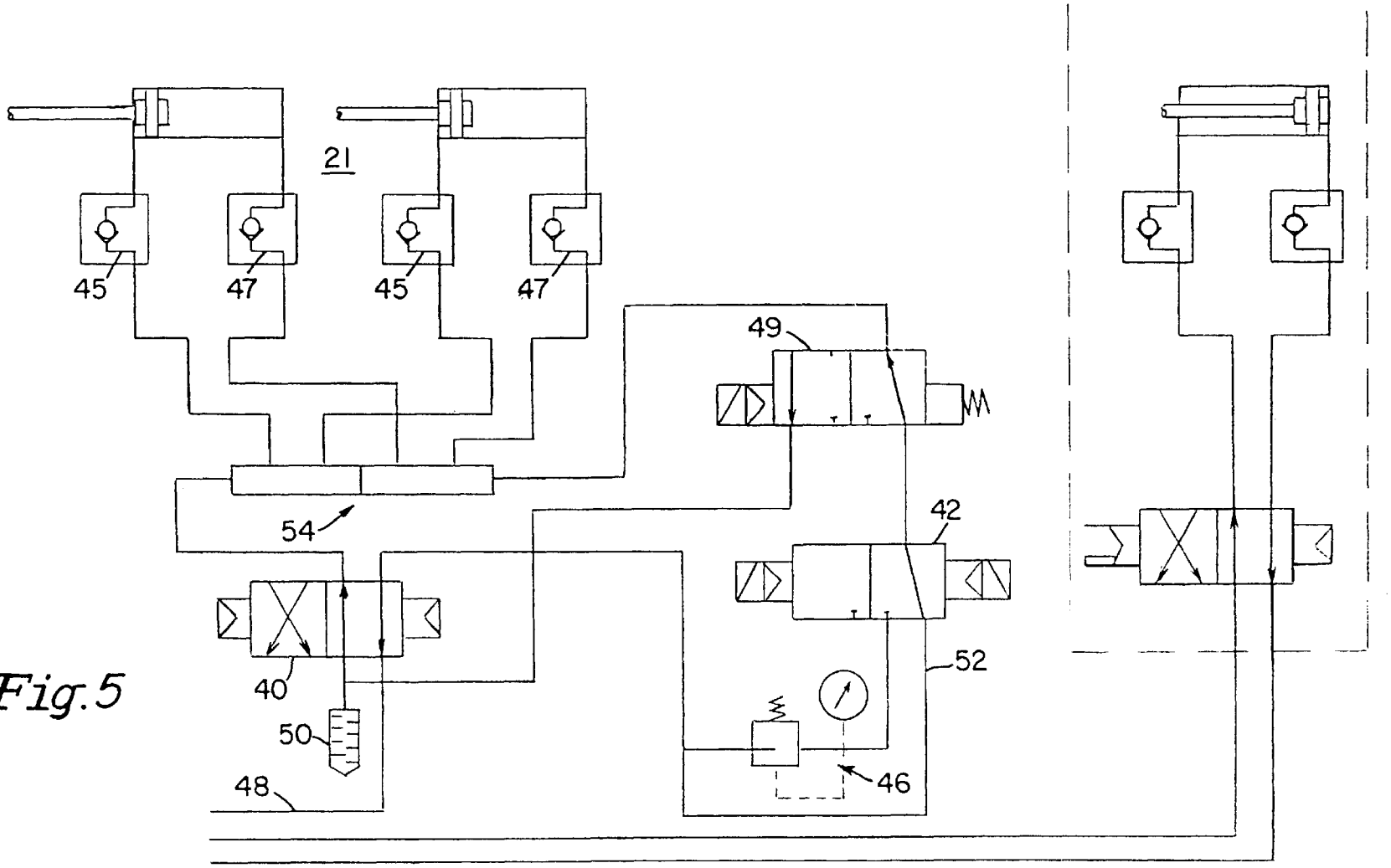
FIG. 5 is a schematic diagram of the modification of the valving to achieve the purposes of the present invention.

Referring now specifically to FIG. 5, the modified valve structure for control of air cylinder 21 is illustrated. Air cylinder 11 remains controlled by valve C–D. A four-way valve 40, two three-way valves 42 and 44 and a pressure regulator 46 are added to the pneumatic system.

A pressure of 6 bar derived via lead 48 from the pressure supply 41 illustrated in FIG. 3, is applied to port 1 of valve 40. Port 3 of valve 40 is applied to a vent 50. Port 2 is connected to receive air from the cylinder 21 when deflected to its operative position. Port 4 of valve 40 is connected via pressure regulator 46 to port 1 of valve 42 and via lead 52 to port 3 of valve 42. Output port 2 of valve 42 is connected to port 3 of valve 44 while its port 2 is connected to manifold 54 of the control for cylinder 21.

In operation and reference is made now to FIG. 6 as well as FIG. 5, upon valve 40 assuming the position illustrated in FIG. 5; the valve 42 causes its port 2 to be in communication with port 1 and simultaneously valve 49 is shifted momentarily (via timer) to allow port 2 to communicate with port 1 to allow relief of high pressure (6 bar) air through vent 50. A pressure of 1 bar is applied via regulator 46 to the manifold 54 since valve 49 is returned to a position providing communication between ports 2 and 3. Such communication causes the piston of cylinder 21 to extend under 1 bar of pressure resisting it from collapsing thereby maintaining element 25 at a distance from bird beak side 3. After a predetermined time that depends on bag size, the valve 40 is actuated to interconnect ports 1 and 2 of the valve (as illustrated in FIG. 5) and high pressure is applied to manifold 54 to collapse element 25 against side 3 under 6 bar pressure. With valve 40 in the position illustrated exhaust air from cylinder 21 retracting is directed to vent 50. Reversal of the interconnection of the ports of valve 40 causes the piston of cylinder 21 to return to the home (extended) position illustrated in FIG. 5. Having assumed its home position the piston of cylinder 21 is rested there by action of valve 40 to interconnect its ports 1 and 2.

In the operation described in FIGS. 5 and 6, the opening of the face clamps by cylinder 11 pulls the side sealing clamps 25–27 toward the spout by the change in geometry of the bag as the bird beak opens. The outward pressure on the side sealing air cylinder 21 prevents gravity from drawing the side sealing clamps 25–27 against the side of the spout 2–3 thus creating openings between the bag and the side of the spout for external venting. These openings are then closed by application of 6 bar pressure through the valving sequence which directs high pressure to the opposite port on this cylinder.

Once given the above disclosure, many other features, modifications and improvements will become apparent to the skilled artisan. Such features, modifications and improvements are, therefore, considered to be a part of this invention, the scope of which is to be determined by the following claims.

We claim:

1. A bag filling apparatus having a spout, a bird beak, bird beak expending flaps (10) operated by a first cylinder (11), first clamping members (15) operated by a second cylinder (17), lever arms (19) operated by a third cylinder (23) and second clamping members (25) operated by a fourth cylinder (21), all of said manifolds, said cylinders 17, 21 and 23 being actuated to expand said bird beak once a bag in installed and clamp the bag against said bird beak and spout and means for supplying air at a high pressure; the improvement characterized by a pressure regulator, said pressure regulator developing a low pressure fluid from said high pressure fluid, a first valve said first valve supplying pressurized fluid via said pressure regulator to a first port of said first valve and at a higher pressure directly to a second port of said valve, said valve having an output port, means for directing fluid from said first and second ports, alternatively, to said output port, and means for initially supplying lower pressure fluid from said output port to said fourth cylinder 21 to move said clamping means slowly towards the sides of a bag and after a predetermined time moving said cylinder rapidly to seal the sides of a bag against said spout.

2. The apparatus as set forth in claim 1 further characterized by said means for initially supplying constituting a second valve having a first and a second position, said first position connecting the output port of said first valve to said manifold to actuate said fourth cylinder 21 and in said second position terminating flow of fluid to said cylinders.

3. The apparatus as set forth in claim 2 further characterized by said fourth cylinder 21 having means for exhausting fluid through manifolds from either side of said piston of said fourth cylinder upon pressure being applied to the opposite side of said piston.

4. The apparatus as set forth in claim 3 further characterized by a third valve having two positions for alternatively exhausting fluid from one side and the other of the piston of said fourth cylinder 21.

5. The method according to claim 1, wherein the lower pressure is 1 bar and the higher pressure is 6 bar.

6. The method of externally exhausting air from a bag clamped on a filling spout comprising the steps of clamping front and back surfaces of a bag disposed about an expandable filling spout, slowly moving the side surfaces of the bag towards edges of the filling spout to permit during a bag filling operation escape of fluid from openings between the sides of the bag and the filling spout, and rapidly moving the side surfaces of said bag toward edges of said filling spout commencing on predetermined time after initiation of the slow movement of the side surfaces of the bag.

7. The method according to claim 6 wherein, the predetermined time is determined by the size of the bag.

* * * * *